US005143279A

United States Patent [19]

Gaines

[11] Patent Number: 5,143,279

[45] Date of Patent: Sep. 1, 1992

[54] GIFT CARD AND ENVELOPE

[76] Inventor: Alfred L. Gaines, 1315 Randolph St., NW., Washington, D.C. 20011

[21] Appl. No.: 589,596

[22] Filed: Sep. 28, 1990

[51] Int. Cl.[5] ..... B65D 27/00

[52] U.S. Cl. ..... 229/68 R; 229/71; 283/58

[58] Field of Search ..... 229/68 R, 70, 71, 73, 229/92.1, 92.3; 283/58

[56] References Cited

U.S. PATENT DOCUMENTS

| | | | |
|---|---|---|---|
| 927,543 | 7/1909 | Irvin | 229/68 R X |
| 1,141,172 | 6/1915 | Clark | 229/71 X |
| 1,371,670 | 3/1971 | Dority et al. | 229/68 R X |
| 2,347,075 | 4/1944 | Berkowitz | 229/70 |
| 2,987,327 | 6/1961 | Carmichael | 229/68 R X |
| 3,111,336 | 11/1963 | Schumacher | 229/73 X |
| 3,187,986 | 6/1965 | Simjian | 229/68 R |
| 3,497,242 | 2/1970 | Seidman | 283/106 X |
| 3,672,703 | 6/1972 | Jayu | 283/58 X |

FOREIGN PATENT DOCUMENTS

| | | | |
|---|---|---|---|
| 250017 | 3/1911 | Fed. Rep. of Germany | 229/71 |
| 227015 | 1/1925 | United Kingdom | 229/73 |

*Primary Examiner*—Gary E. Elkins
*Assistant Examiner*—Jes F. Pascua
*Attorney, Agent, or Firm*—Wiliam F. Frank

[57] ABSTRACT

The present invention combines a provision for giving a monetary gift in the form of a check and a permanent record on the accompanying gift card of the giver and the amount of the check. The invention comprises a combined special gift card and acompanying envelope. In a second embodiment, the envelope carrie a detachable, otherise valid, check which is included with the aforementioned card.

7 Claims, 6 Drawing Sheets

GIFT CARD AND ENVELOPE

FIELD OF INVENTION

The present invention is in the general field of gift cards. More specifically, the invention is in the field of special occasion greeting cards including a monetary gift.

BACKGROUND OF THE INVENTION

Gift giving for such occasions as birthdays, weddings, religious occurrences, holidays, anniversaries and the like is a longstanding habit of people in all nations. Generally, such gifts are in the form of material objects which are purchased and gift wrapped and presented with an appropriate greeting card. Often the gift giver doesn't want to give a material gift for such reasons as not knowing what the proposed recipient needs or wants or does not have a sufficiently personal relationship with the proposed recipient to warrant selecting a material gift. In these instances the gift giver usually opts for a monetary gift, a gift particularly appreciated by those just starting a marriage and not yet having determined what they will need or want in establishing their new household.

Monetary gifts are usually in the form of cash or a check. There are bifold greeting cards suitable for the particular occasion which have a cover marking the occasion, an appropriate sentiment on one of the interior faces of the card and a pocket on the opposing face of the card into which the giver places the monetary gift. Once the monetary gift is removed from the pocket, there is no permanent record of the amount of the gift or the giver if the giver did not sign the card which can occur. The retention of such gift cards as memorabilia of the occasion often does not occur despite the occasion unless there was a feature of the card that was noteworthy or from a special giver. As years pass from the occasion, memories of the amount of the gifts become clouded and can result in unnecessary arguments, sometimes acrimonious.

SUMMARY OF THE PRESENT INVENTION

The present invention combines a provision for giving a monetary gift in the form of a check and a permanent record on the accompanying gift card of the giver and the amount of the check. The invention comprises a combined special gift card and accompanying envelope. In a second embodiment, the envelope carries a detachable, otherwise valid, check which is included with the aforementioned card.

BRIEF DESCRIPTION OF THE DRAWINGS

The embodiments of the present invention are illustratively shown in the accompanying drawings which depict the principles of the present invention.

DETAILED DESCRIPTION OF THE INVENTION

Figure 1:
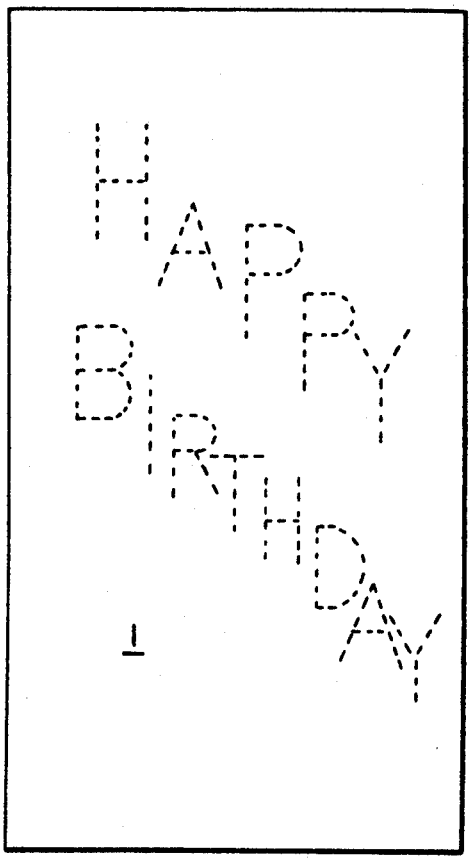
FIG. 1 is a plan view of the front surface of one embodiment of the card the present invention.
Figure 2:
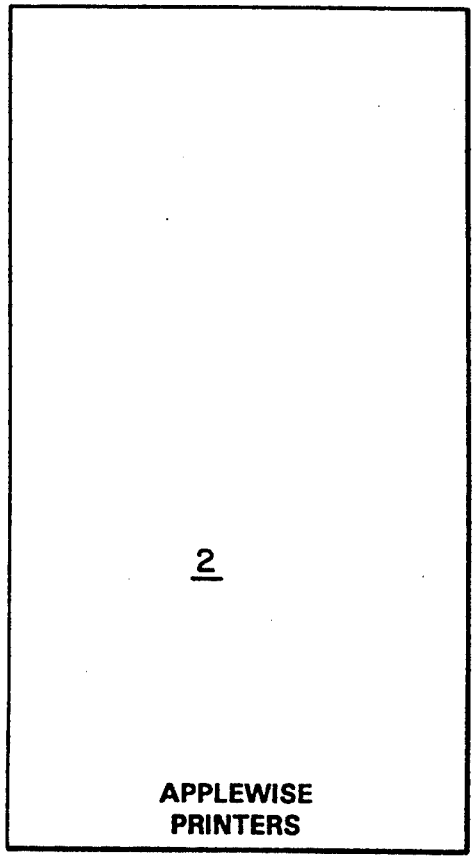
FIG. 2 is a plan view of the rear surface of the embodiment of the present invention in FIG. 1.

Referring now to FIGS. 1–4, this embodiment of the greeting card of the present invention is illustratively shown to be of rectilinear configuration for purpose of description. It is to be understood that configurations such as the outline of an egg or a bell are to be within the scope of this invention. It comprises a bifold card with a front panel 1 whose surface having thereon simulated indicia and/or design indicating in general the occasion for which the card is being given. The surface of rear panel 2 of the card may be blank or carry indicia relating to the occasion and/or the identifying markings of the printer or company printing the card. The interior surface 3 of the front panel 1 carries a fanciful border 4. Interior of this border is what may be characterized as a skeletonized check whereon there is a space 5 upon which a date will appear as will be subsequently described. Below space 5 will be seen an indicator 6 and space 7 for designating to whom the money is given and a conventional symbol 8 for insertion of the numerical amount of the gift. Below indicator 6 there is a space 9 for insertion of the written amount of the gift. On the lower right hand portion of surface 3 is a space 10 for the signature of the card presentor.

Figure 8:
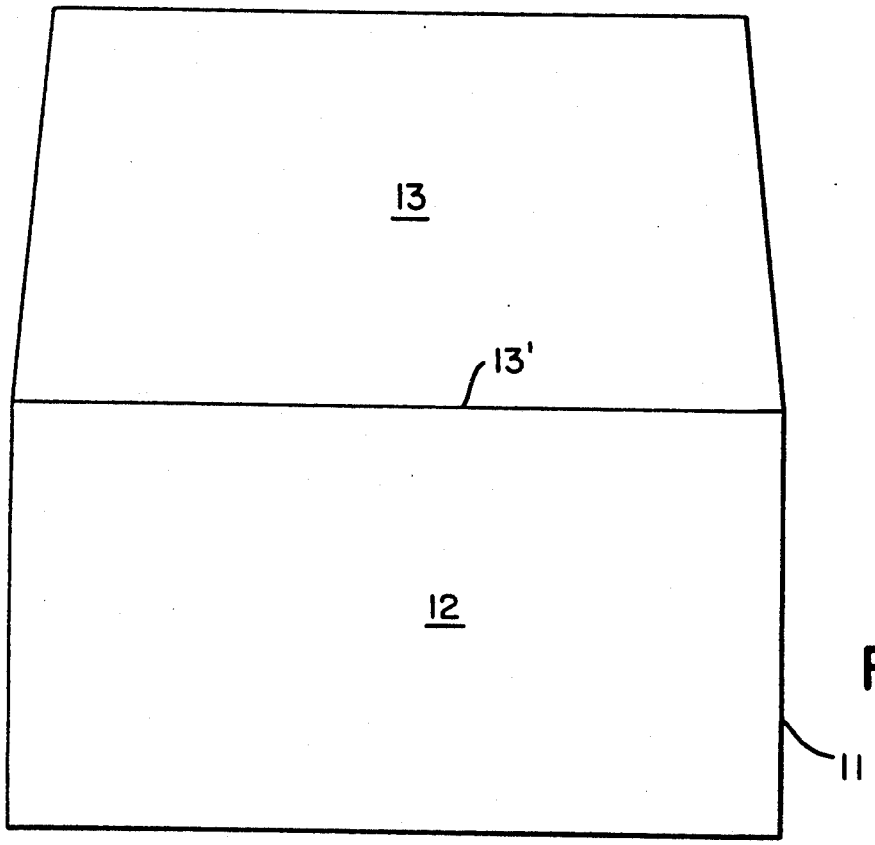
FIG. 8 is a plan view of one side of an envelope for use with the embodiments seen in FIGS. 1–7.
Figure 9:
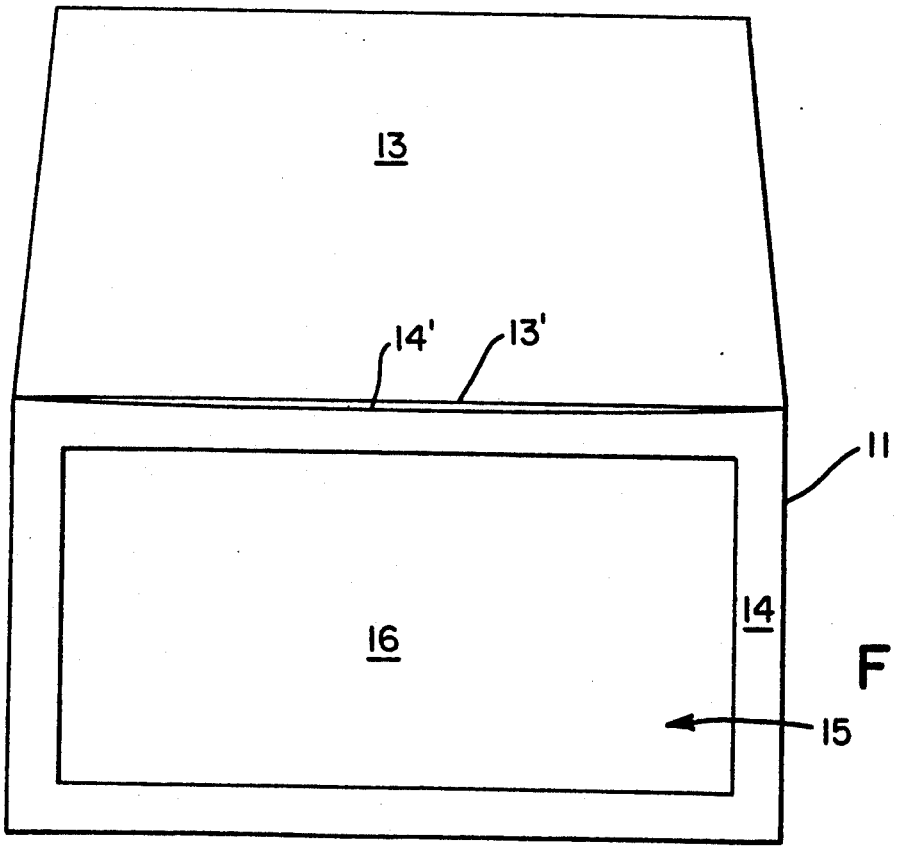
FIG. 9 is a plan view of the opposite side of the envelope seen in FIG. 8.

Referring now to FIGS. 8 and 9 there is shown an envelope 11 of a rectilinear configuration and size to receive the card of FIGS. 1–4. Envelope 11 has a front surface 12 to receive the name of the recipient (and address if the card is to be mailed) and a contiguous flap 13 which will be seen to be slightly less in width than envelope 11. The rear surface 14 of the envelope 11 has an opening 15 therein which surrounds an insert 16 of an indicia transfer material. The insert 16 can make a transfer of indicia in such color as may be desired. The opening 15 is of a size of a conventional check. Rear surface 14 has a broad V-shaped opening 14' adjacent fold line 13' of flap 13 to facilitate insertion of the greeting card of this invention.

Figure 5:
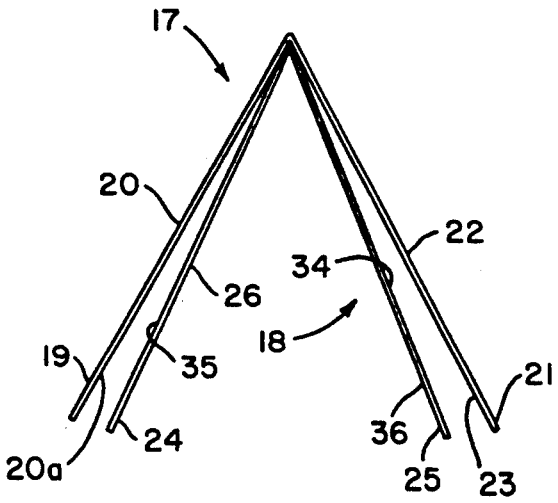
FIG. 5 is a vertical top view of the card of the second embodiment of the present invention, the bottom view being substantially identical.
Figure 6:
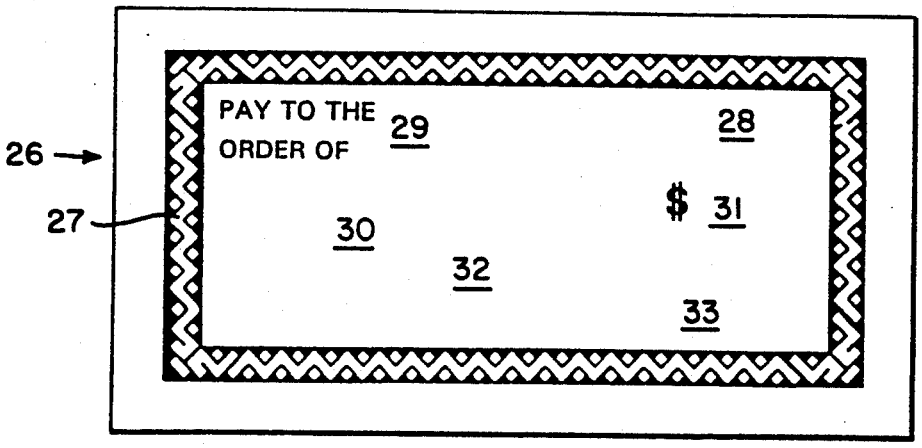
FIG. 6 is a plan view of the interior surface of one side of the bifold insert seen in FIG. 5, the obverse side being blank.
Figure 7:
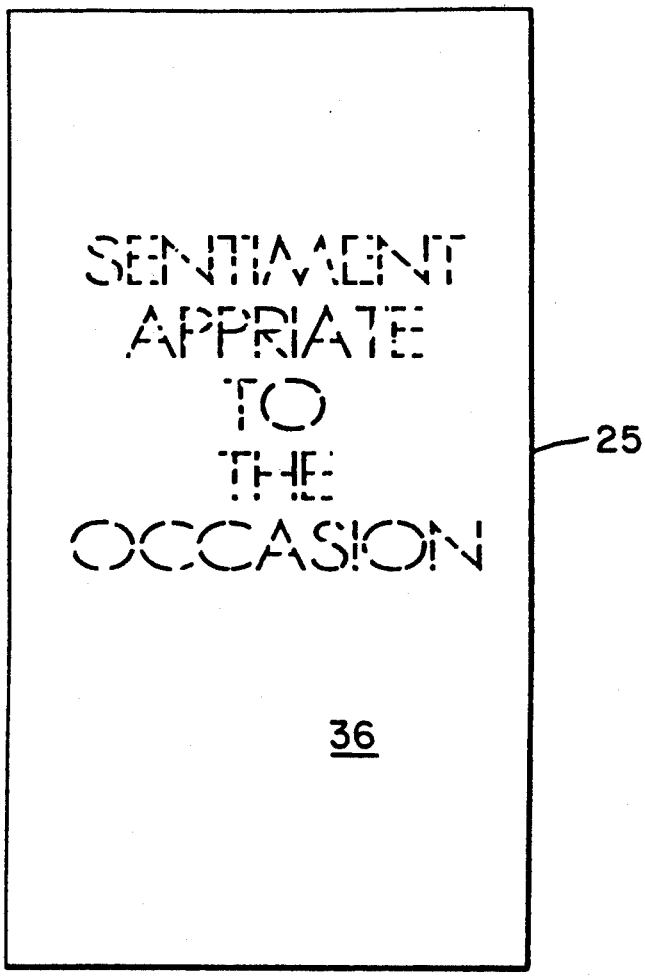
FIG. 7 is a plan view of the interior surface of the second side of the bifold insert seen in FIG. 6, the obverse side being blank.

FIGS. 5–7 show that the second embodiment of the greeting card of the present invention comprises a dual, bifold card consisting of an outer bifold card 17 and an inner bifold card 18. Outer card 17 is substantially identical to the single bifold card seen in FIGS. 1 and 3. That is, card 17 has a front panel 19, the surface 20 of which bears an indicia indication of the occasion, and a rear panel 21 the surface 22 of which generally will be unadorned except for the selective imprint of the card purveyor. The inner surface 20*a* of panel 19 will generally be blank although it may carry an imprint commensurate with the occasion. The inner surface 23 of panel 21 will normally be identical to surface 20*a* of panel 19.

Figure 3:
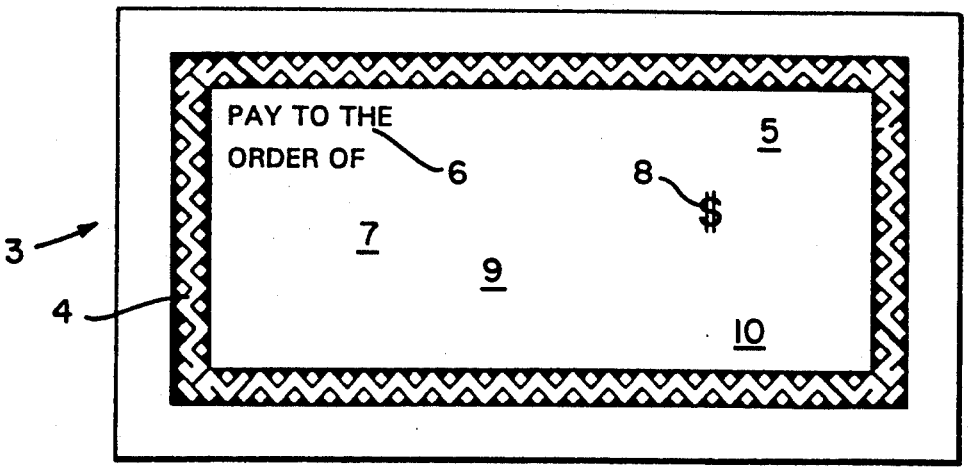
FIG. 3 is a plan view of the interior surface of the interior of the embodiment seen in FIG. 1.
Figure 4:
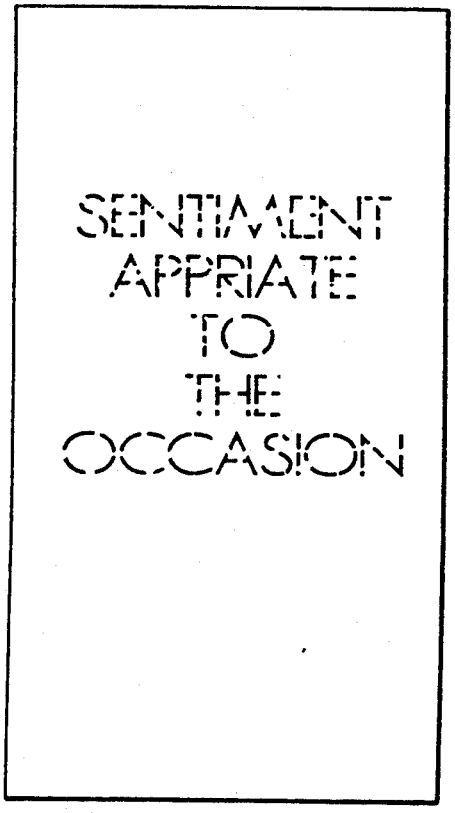
FIG. 4 is a plan view of the interior surface of the interior of the embodiment seen in FIG. 3.

Inner bifold card 18 will generally be a duplicate of the single bifold card seen in FIGS. 3 and 4, that is, having a front panel 24 and a rear panel 25. The interior surface 26 of the front panel 24 carries a fanciful border 27. Interior of this border is what may be characterized as a skeletonized check whereon there is a space 28 upon which a date will appear as will be subsequently described. Below space 28 will be seen an indicator 29 and space 30 for designating to whom the money is given and a conventional symbol 31 for insertion of the numerical amount of the gift. Below indicator 29 there is a space 32 for insertion of the written amount of the gift. On the lower right hand portion of surface 26 is a space 33 for the signature of the card presentor. The exterior surface 34 of panel 25 will generally be blank but may carry the imprint of surface 22 of panel 19. The interior surface 36 of panel 25 carries an appropriate greeting.

The envelope seen in FIGS. 8 and 9 and previously described can also be used with the second embodiment.

Figure 12:
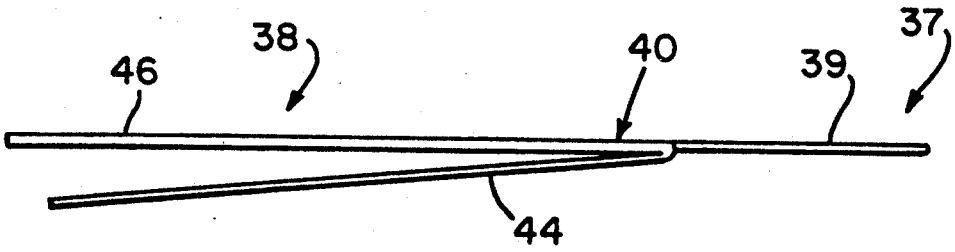
FIG. 12 is a side elevation view of FIG. 10.
Figure 10:
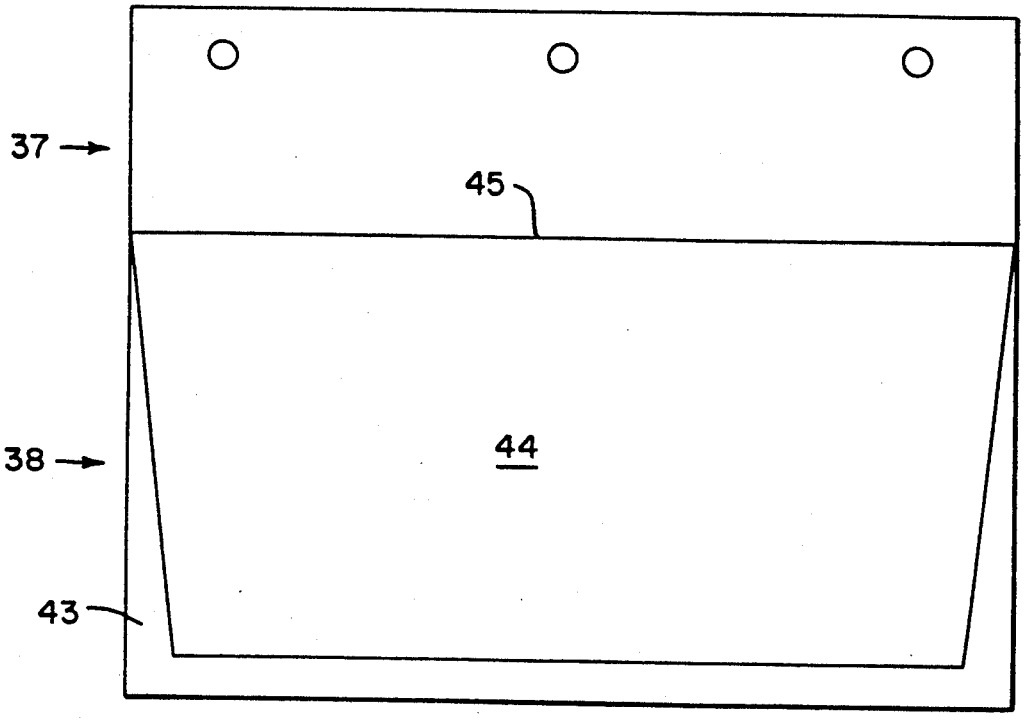
FIG. 10 is a plan view of one side of the envelope comprising the second embodiment of the invention seen in FIGS. 8 and 9.
Figure 11:
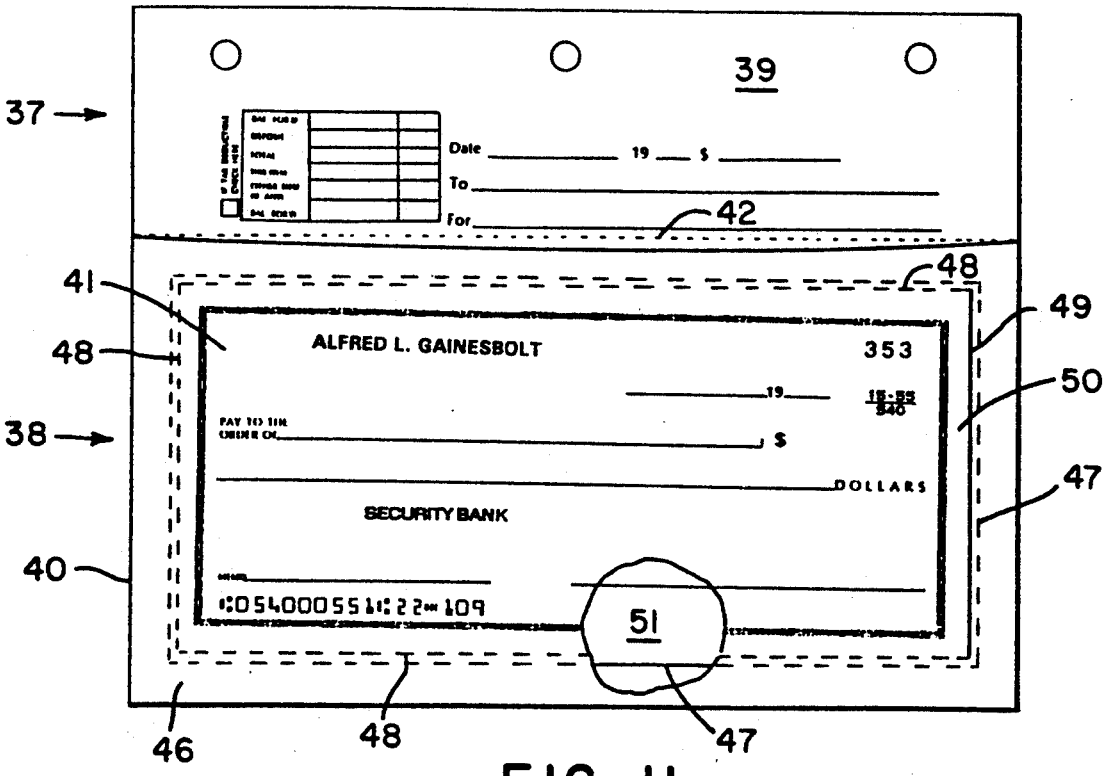
FIG. 11 is a plan view of the opposite side of the envelope seen in FIG. 10 in partial section.

The envelope embodiment seen in FIGS. 10–12 can be seen to be a combined check and envelope. As can be seen the embodiment comprises an upper portion 37 and lower portion 38, upper portion 37 disclosing a check register 39 of a type conventionally seen and available and is considered to be self-descriptive without additional elaboration, and a lower portion 38 disclosing an envelope 40 and a blank check 41 positioned on envelope 40. Lower portion 38 and upper portion 37 are connected by a perforation 42 which permits portion 38 to be easily detached from portion 37. Envelope 40 is generally identical to envelope 11 shown and described with reference to FIGS. 8 and 9 in that it has a front surface 43 to receive the name of the recipient (and address if the card is to be mailed) and a contiguous flap 44 which will be seen to be slightly less in width than envelope 40 and a fold line 45. The rear surface 46 of envelope 40 has an opening 47 therein which surrounds an insert 48 of an indicia transfer material. The insert 48 can make a transfer of the indicia in such color as may be desired. The opening 47 is of the size of a conventional check 41. As can be seen check 41 is detachable from surface 46 by reason of perforations 48 along three sides of check 41 and a slit 49 which permits edge 50 of check 41 to be grasped to cause separation of check 41 from surface 46 along perforations 48.

Figure 13:
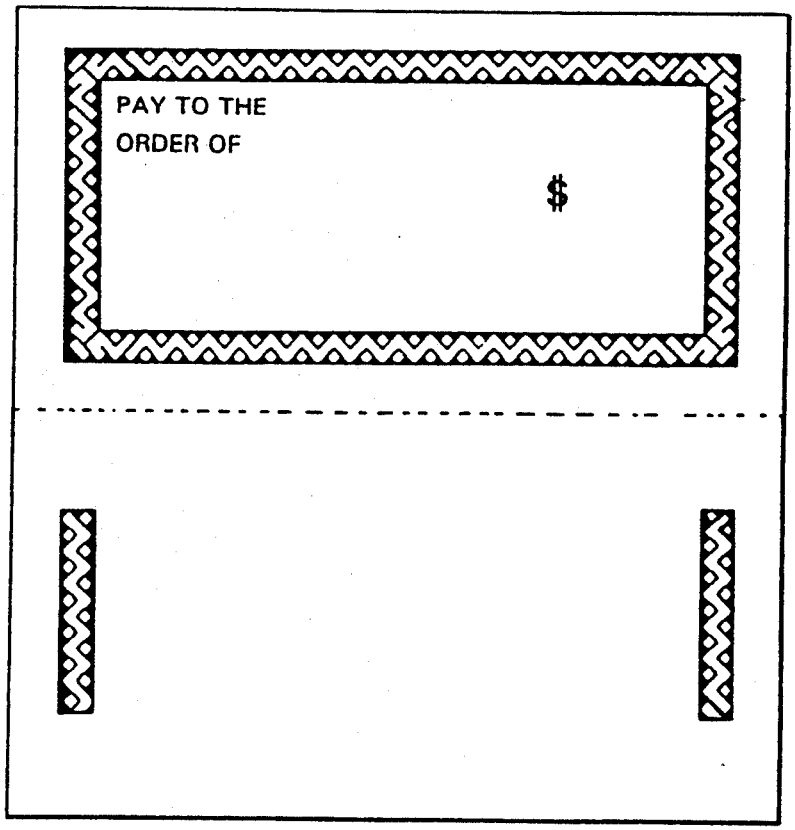
FIG. 13 is a plan view of the interior of the embodiment of FIG. 3 or FIG. 6 when the card has been prepared for presentation.

FIG. 13 is believed to be self-descriptive of that portion of the present invention and does not require elaboration.

Figure 14:
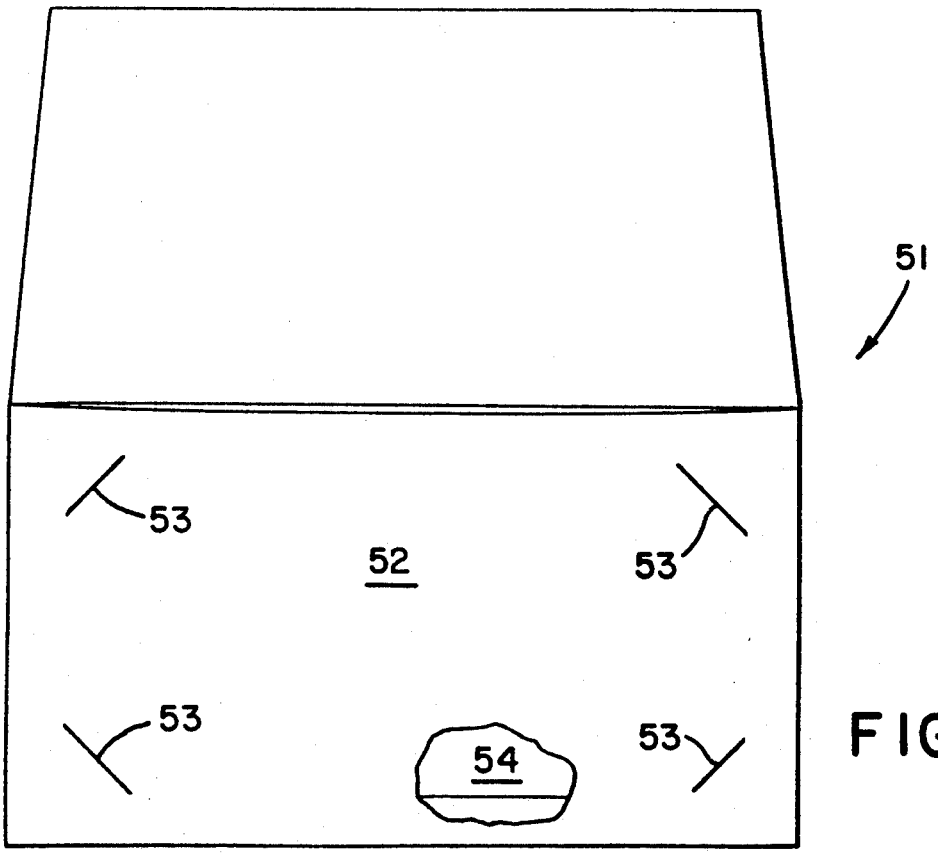
FIG. 14 is a plan view in partial section of another embodiment of FIG. 9.

FIG. 14 is generally identical to FIG. 9 with the following changes. The envelope 51 has a surface 52 which is without an opening similar to opening 15 in FIG. 9. In place of the opening 15 there are four slits 53 positioned to accept the corners of a check and retain the check in place while writing on it. Indicia transfer material is secured to the inner side of surface 52. The stock material from which envelope 51 is formed is sufficiently resilient to permit the transfer of the entries made on a check inserted into slits 53 through the indicia transfer material onto the appropriate surface of the card to be enclosed in the envelope.

To insure indicia is correctly transferred to the appropriate surface of the card shown in FIGS. 1–4 or 5–7, the card is folded in reverse so that the surface of front panel 1 and surface of rear panel 2 contact each other. The thus folded card is inserted into the envelope so that interior surface 3 of front panel 1 is aligned with indicia transfer material insert 16. The check is then properly positioned on the rear surface of the envelope 11 or 51 and appropriately filled in. The embodiment of the card of the present invention as seen in FIGS. 5–7 is similarly folded so that interior surface 26 can be aligned with the indicia transfer material on the appropriate envelope.

Such changes in shape and/or size as may occur to those of skill in the art are considered to come within the scope of the following claims.

What is claimed is:

1. Means for presenting a monetary gift comprising in combination an envelope and associated card, said envelope having a front surface and a rear surface with a flap contiguous with said front surface, said rear surface having means positioned on one side of said surface to position a check on one side of said surface and indicia transfer material positioned on an opposite side of said rear surface in alignment with said check positioning means: said card having front and rear panels, each front and rear panel, respectively, having an interior surface, said interior surface on one panel resembling a skeletonized check form and said interior surface on said other panel bearing an appropriate sentiment.

2. The monetary gift means according to claim 1 wherein said check positioning means comprises an opening in said one surface of the size of a conventional check.

3. The monetary gift means according to claim 1 wherein said check positioning means comprises four slits in said surface, said slits being positioned so that each slit can accept a corner of said check.

4. The monetary gift means according to claim 1 wherein said envelope is a combined check and envelope, and comprises an upper portion and a lower portion, said upper portion disclosing a check register of a type conventionally seen and available, said lower portion disclosing said envelope and a blank check positioned on said rear surface of said envelope, the blank check further being so positioned on said rear surface of said envelope as to be aligned with said indicia transfer material positioned on the opposite said of said rear surface, said lower and said upper portion being connected by a line of perforations which permits said lower portion to be easily detached from said upper portion; said blank check being positioned on said lower portion and detachable from said lower portion surface by reason of a line of perforations along three sides of said check and a slit along the fourth side which permits said check fourth side to be grasped to cause separation of said check from said surface along said lines of perforations.

5. The monetary gift means according to claim 1 wherein said envelope is a combined check and envelope, and comprises an upper portion and a lower portion, said upper portion disclosing a check register of a type conventionally seen and available, said lower portion disclosing said envelope and a blank check positioned on said rear surface of said envelope, the blank check further being so positioned on said rear surface of said envelope as to be aligned with said indicia transfer material positioned on the opposite said of said rear surface, said lower and said upper portion being connected by a line of perforations which permits said lower portion to be easily detached from said upper portion; said blank check being positioned on said lower portion and detachable from said lower portion surface by reason of a line of perforations along three sides of said check and a slit along the fourth side which permits said check fourth side to be grasped to cause separation of said check from said surface along said lines of perforations.

6. Means for presenting a monetary gift comprising in combination an envelope and associated card, said envelope having a front surface and a rear surface with a flap contiguous with said front surface, said rear surface having means positioned on one side of said surface to position a check on one side of said surface and indicia transfer material positioned on an opposite side of said rear surface in alignment with said check positioning means: said card having front and rear panels, each front and rear panel, respectively, having an interior surface, said interior surface on one panel resembling a skeletonized check form and said interior surface on said other panel bearing an appropriate sentiment said check positioning comprising and opening in said one said surface of said envelope of the size of a conventional check.

7. The monetary gift means according to claim 6 wherein said check positioning means comprises four slits in said surface, said slits being positioned so that each slit can accept a corner of said check.

* * * * *